United States Patent [19]

Jacuzzi et al.

[11] Patent Number: 4,852,190

[45] Date of Patent: Aug. 1, 1989

[54] DOUBLE CASCADE SPOUT

[75] Inventors: Remo Jacuzzi; Eugene C. Smith, both of Little Rock, Ak.

[73] Assignee: Jason International, Inc., Little Rock, Ak.

[21] Appl. No.: 170,230

[22] Filed: Mar. 18, 1988

[51] Int. Cl.[4] ..... E03C 1/04

[52] U.S. Cl. ..... 4/192; 4/191; 4/541; 4/542; 137/594; 251/175; D23/242

[58] Field of Search ..... 4/191, 192, 194, 195, 4/492, 507, 601, 591; D23/201, 213, 222, 228, 238, 239, 240, 241, 242, 243, 255, 256, 257; 137/801, 597, 594

[56] References Cited

U.S. PATENT DOCUMENTS

| | | | |
|---|---|---|---|
| D. 290,159 | 6/1987 | Jans | D23/242 |
| D. 292,430 | 10/1987 | Enthoven | D23/241 |
| 1,331,025 | 2/1920 | Riggin | 251/86 |
| 3,228,652 | 1/1966 | Antrim | 251/175 |
| 3,871,406 | 3/1975 | Anderson | 4/191 |
| 4,181,987 | 1/1980 | Kesselman | 4/191 |
| 4,334,328 | 6/1982 | Delephine | 4/191 |
| 4,513,458 | 4/1985 | Delepine | 4/191 |
| 4,590,628 | 5/1986 | Degregorio | 4/191 |
| 4,667,349 | 5/1987 | Son | 239/575 |

FOREIGN PATENT DOCUMENTS

| | | | |
|---|---|---|---|
| 813156 | 5/1959 | United Kingdom | 137/594 |
| 889150 | 2/1962 | United Kingdom | 137/594 |
| 1034215 | 6/1966 | United Kingdom | 137/801 |
| 1569719 | 6/1980 | United Kingdom | 137/801 |
| 2110340 | 6/1983 | United Kingdom | 137/597 |
| 2124335 | 2/1984 | United Kingdom | 137/801 |

OTHER PUBLICATIONS

Jacuzzi Whirlpool Bath Publication, Copyright No. 6683000B (1985).

Charles Murray, ed. Bath Spout Produces Waterfall Effect, Design News (Mar. 7, 1988).

*Primary Examiner*—Henry J. Recla
*Assistant Examiner*—D. Stein Freer
*Attorney, Agent, or Firm*—Fidelman & Wolffe

[57] ABSTRACT

A double cascade spout unit particularly adapted for use in whirlpool baths and spas wherein both filling and recirculation may be realized with a cascade or waterfall effect.

28 Claims, 5 Drawing Sheets

DOUBLE CASCADE SPOUT

PRIOR ART CROSS-REFERENCES

U.S. Pat. No. 4,334,328—Jean C. Delepine—WIDE—MOUTHED SPOUT FOR FLOW OF LIQUID—Issued June 15, 1982.

U.S. Pat. No. 4,590,628—Anthony DeGregorio—FOUNTAIN DEVICE—Issued May 27, 1986.

U.S. Pat. No. 4,667,349—Lee C. Son—WATER SAVING STOPCOCK—Issued May 26, 1987.

U.S. Pat. No. 4,181,987—Joseph J. Kesselman—ON—OFF SNAP ACTION WATER AND HEAT SAVING VALVE ATTACHMENT FOR SINK SPOUT—Issued Jan. 8, 1980.

Jacuzzi Whirlpool Bath Publication, Copyright No. 6683000B, 1985.

BACKGROUND OF THE INVENTION

The present invention relates to whirlpool baths. More particularly, the present invention relates to a unitary device characterized by separate delivery and recirculation spouts for liquids used in whirlpool baths.

Various liquid delivery or filling devices for use in conjunction with tubs, basins and whirlpool units are known in the art, as well as various recirculation devices for whirlpool units. A particularly desirable wide mouth spout for effecting liquid delivery to various receptacles has been made available in the art, as for example, in U.S. Pat. No. 4,334,328 to Jean C. Delepine, which spout is designed to ameliorate the noise level during filling and to eliminate the need for antisplash nozzles in filling operations involving tubs and basins of known construction.

Similarly, wide mouth spouts have also been employed, operatively connected to hot and cold water pipes, to provide a filling means for whirlpool baths.

Whirlpool baths or spas for health as well as for pleasure are well known and are becoming increasingly popular. Such units involve, briefly, a vessel or container into which water of varying, selected temperatures is introduced for bathing purposes. A recirculation pump draws water from the filled bath/vessel and recirculation of the water is effected by means of submerged nozzle/venturi fittings.

In certain units, as an additional feature, air is introduced by means of air inlet zones about the periphery of the nozzle with the air drawn into the stream of water by venturi action. The air emerges from the nozzle as bubbles within the stream of water, to provide aeration to the body of water and/or a vigorous massage of the body of the bather.

It is an object of the present invention to provide a laminar cascade delivery system for whirlpool baths or spas wherein separate filling and recirculation of a liquid may be effected by means of separate spouts incorporated in a unitary device.

In accordance with the present invention there is provided a unitary double cascade unit for use in whirlpool bath or spa applications wherein means are provided to independently recirculate a portion of the liquid from the bath to provide a cascade or waterfall effect through and issuing from one spout while filling of the bath is accomplished using a separate spout opening, also achieving a cascade or waterfall effect.

To this end, in accordance with the invention there is provided a wide mouth double cascade liquid delivery unit for dispensing a curtain of liquid therefrom comprising superimposed elongated, wide and flat upper and lower liquid receiving and dispensing chambers, each of the chambers being in communication with the atmosphere via a long, narrow slot in a side of the chamber, the length of said slot being substantially equal to the length of the cross-section of said chamber transverse to the flow of the liquid from the chamber. Plumbing pipes for delivering liquid are operatively connected to each chamber. One of the liquid delivery pipes is connected to a source of hot and cold water, and the other to the whirlpool bath for liquid recirculation.

Control of the liquid flow is regulated by suitable valving means in the pipes, the valving means preferably located at or near the point of entry of the pipe into the chamber, with individual exterior valve controls provided on the opposite end walls of the delivery unit.

Installation of the unit to a bath is effected by mounting the unit to the lip of the bath by suitable, selected mounting means sufficient to maintain the unit securely attached to the bath, e.g., by threaded inserts. Anchoring components integrally attached to the bottom of and extending downwardly from the base of the unit are passed through appropriately spaced and numbered holes drilled through the lip, the inserts and unit then secured by means of two lock nuts. Installation is, of course, effected with the slot or water exit side directed to the interior of the bath.

A particularly desirable valve for use in the present unit is a ball valve, such as that disclosed in U.S. Pat. No. 4,590,628 to Anthony DeGregorio, among others, wherein the liquid stream may be readily turned all the way on or off by the simple adjustment of a snap-action lever control.

Additionally, and if desired, the unit can be supplied with removable/replaceable trim pieces for aesthetic values, the trim fabricated of any suitable material, such as plastic, polished stainless steel, copper, chromium or the like.

Aesthetic values may also be imparted to the unit by, e.g., contouring the outer walls or a selected portion thereof. An example of contouring is set out in FIG. 1 in the ribbing design of cover plate 8 and also in the overhead view of plate 8 in FIG. 2.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
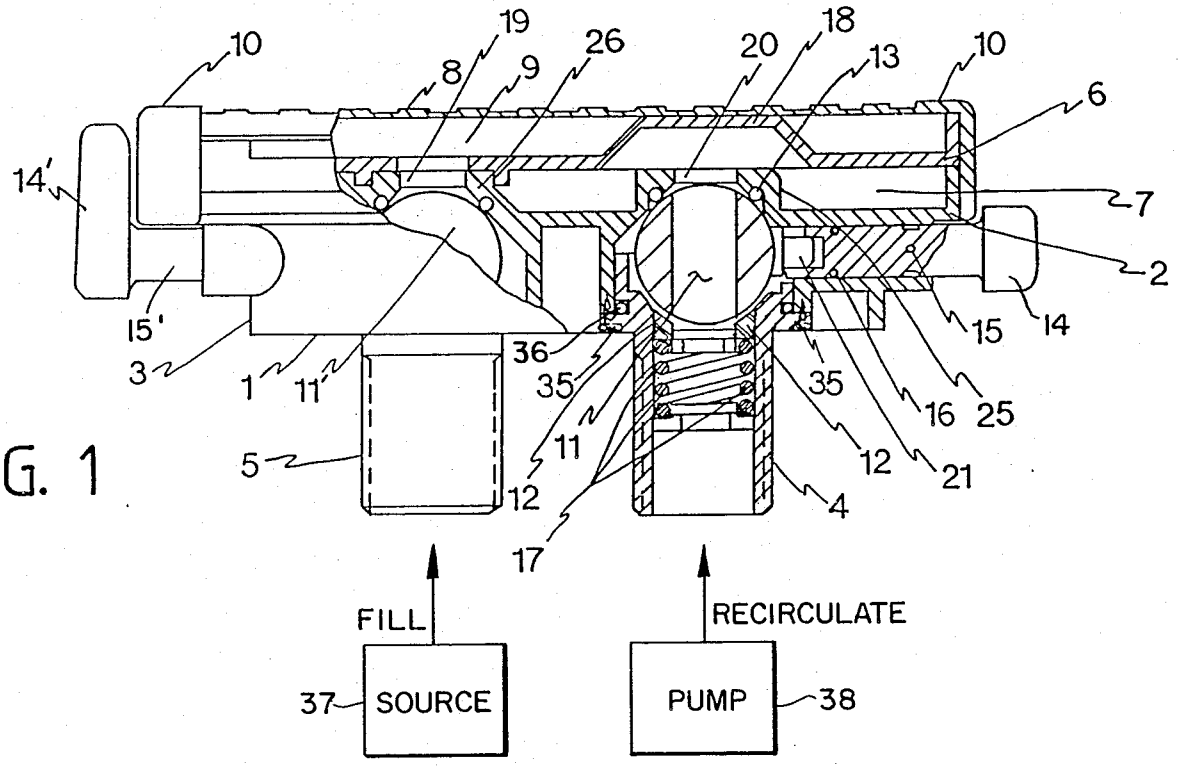
FIG. 1 is cross-sectional view of the unit.

Referring now to FIG. 1, the reference numeral I denotes the double cascade unit of the present invention. The device includes a hollow body portion including a base 2 to which bath securing means (not shown)

are attached; base plate 2 having upwardly extending walls on three sides thereof and bath securing means (not shown) attached thereto; a transversely disposed channeled housing 3 for receiving and retaining the valve control arms 14 and 14', the housing 3 integrally attached to or formed to the underside of base plate 2; a horizontally disposed second or center plate 6 having upwardly extending walls on three sides thereof, the walls corresponding to the walls of base plate 2, plate 6 extending the length and breadth of the unit and with base 2 providing a liquid receiving and discharging cascade chamber 7; and a cover plate 8 overlaying center plate 6 and with plate 6 and the walls thereof providing a second liquid receiving and discharging cascade chamber 9.

A liquid delivery pipe is connected to threaded insert 4 which, with fluid guide 25 of base plate 2, provides a valving chamber for valving means 11. A second liquid delivery pipe is connected to threaded insert 5 which, with fluid guide 26 of base plate 2 provides a valving chamber for valving means 11'. The insert 5 receives fill water from a source 37 of hot and cold mixed water, while the insert 4 receives recirculated water from pump 38.

Opening 20 at the top of fluid guide 25, with proper valve 11 adjustment, allows passage of liquid into chamber 7 via the pipe connected to insert 4.

The top of fluid guide 26 is abutted to the inside of center plate 6 and mated openings at the point of abutment in fluid guide 26 and plate 6 provide a channel 19, allowing passage of liquid into chamber 9 via the pipe connected to insert 5.

Chambers 7 and 9 are closed on both sides and the back, with liquid discharge effected through the front slot openings on the bath side of the unit, as mounted. The base 2 and plate 6, as depicted in FIG. 1 with integral walls and in a stacked configuration, may be securely bound by cover 8 and walls 10 of cover 8.

The spatial arrangement of the walls of base 2 and center plate 6 is such that the walls of plate 6 are an extension of the walls of base 2 providing a uniform outer wall. Cover 8 preferably has downwardly extending walls 10 on the three sides corresponding to and overlaying the walled sides of base 2 and plate 6, the walls structured to provide frictional engagement between the inner surfaces thereof and the outer surfaces of the walls of base 2 and plate 6.

Watertight integrity of the unit may be assured by any means known to the art such as frictional fitting, adhesives, welding and the like.

Threaded inserts 4 and 5 are preferably secured to base 2 by means of removable screws 35, most preferably by using four screws positioned approximately equidistant around the periphery of each threaded insert. Such method of attachment serves to prolong the life of the double cascade spout by permitting access to the valve chambers for replacement of the moving parts, as needed.

As previously discussed, the valving means employed is preferably a ball valve arrangement. In FIG. 1 a typical ball valve liquid passage control means is depicted, with ball valves 11 and 11' mounted in inserts 4 and 5 shown. In FIG. 1, ball valve 11 is shown as mounted in insert 4 by suitable means, such as a washer 12 and an "O" ring 13. Preferably, each valve unit also contains a spring 17 to maintain compression on the ball valves through contact with the washer 12. The inserts 4 and 5 are seated within body 2 with "O" rings 36 sealed therebetween.

Valves 11 and 11' are independently controlled in "on" and "off" positioning by means of levers 14 and 14' mounted to shafts 15 and 15', the shafts extending from the levers to and connected by suitable means with the respective valves through channeled housing 3. Integrity of the valve system is maintained by any suitable means such as, for example, "O" ring 16.

Figure 2:
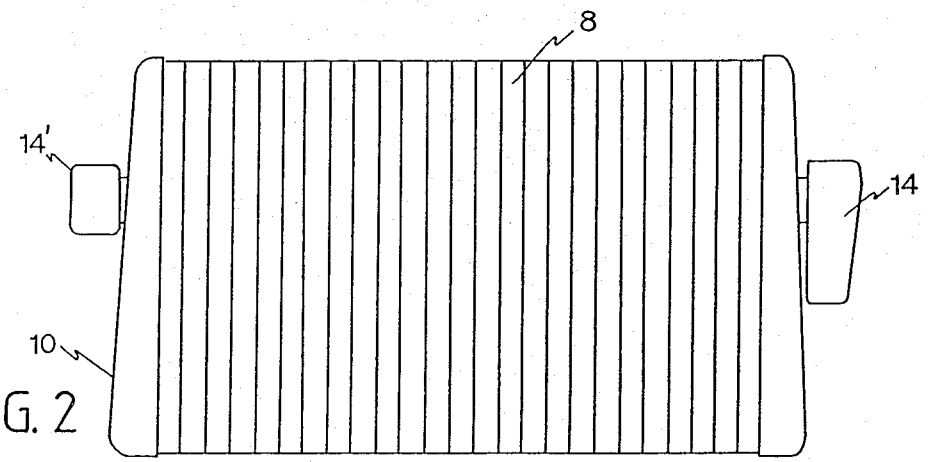
FIG. 2 is a top view of the unit.

FIG. 2 is a planar depiction of cover 8 with walls 10 with liquid flow control levers 14 and 14' shown.

Figure 3:
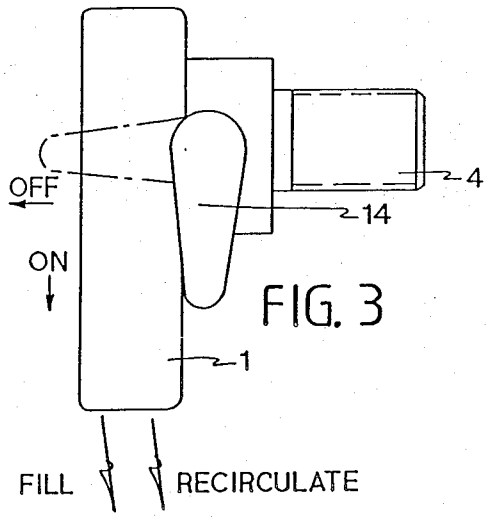
FIG. 3 is an external view of the valve control means.

FIG. 3 is an end view of the unit wherein there is shown a view of the external valve control system with control lever or handle 14 set in "on" position to admit liquid flow to cascade unit 7 via pipe 4, either connected to a fill or to a recirculation line.

Figure 6A:
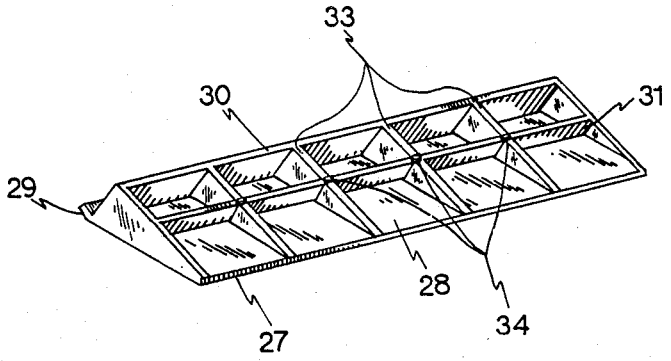
FIG. 6*a* is a perspective view of the ramp configuration.

The front edges of plates 6 and 8, forming the exit side of chambers 7 and 9, may be angled downwardly in parallel relationship to a degree desired to impart a degree of downward motion to the cascading liquid. Alternately, and as shown in FIG. 6, a flow ramp 27 may be utilized to direct the liquid flow from either or both of chambers 7 and 9, the ramps fitted to the discharge side of chamber 7 on the underside of center plate 6 and in chamber 9 on the underside of cover 8. As shown in perspective FIG. 6*a*, the ramp 27 consists of a an endwalled flat plate 28, a lip 29 extending the width of ramp 27, a front transversal rib 30, an intermediately placed transversal rib 31, and additional supporting ribs 33. Preferably, ramps are utilized in both chambers.

Figure 6B:
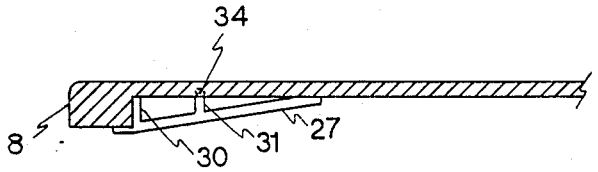
FIG. 6*b* is a cross sectional view of a positioned ramp.

FIG. 6*b* is a cross-sectional view of the abutment of ramp 27 to the underside of cover 8.

The discharge ramps may be frictionally held in place or secured by other means known in the art.

In a preferred mode of positioning and retention as shown in FIGS. 6*a* and 6*b*, transversal rib 31 is. provided with one or more locating pins 34 at selected positions on the top thereof, which pins are frictionfitted into correspondingly placed openings in the bottom of the plate to which the ramp is to be anchored.

FIGS. 4*a–d* are an exploded top view of the unit, showing in perspective the base 2, center plate 6, and top plate or cover 8 and, as an optional decorative attachment, trim piece 32.

Figure 4A:
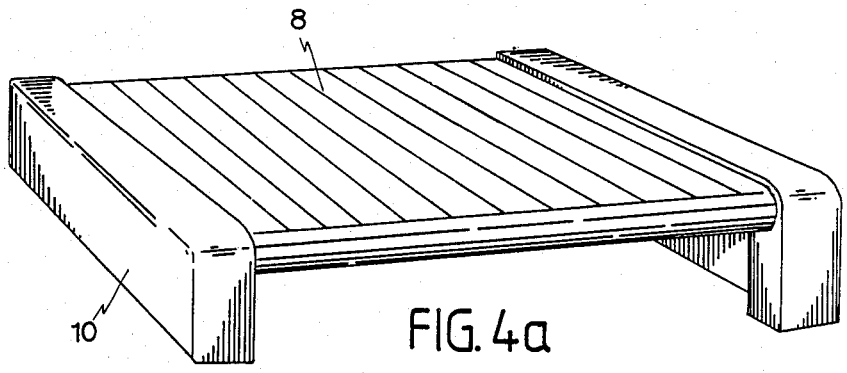
FIGS. 4*a*–4*d* are an exploded top perspective view of the body components and optional trim piece of the unit.
Figure 4B:
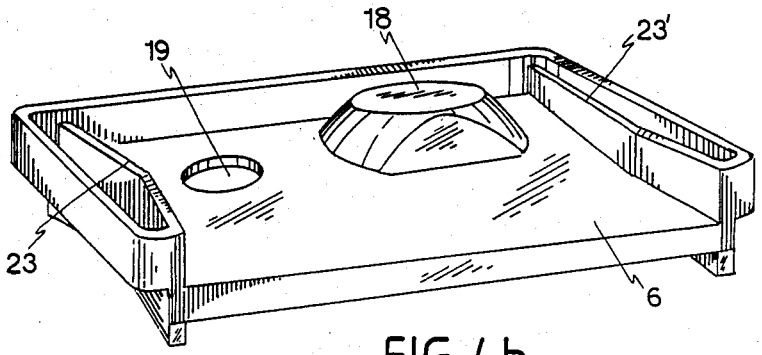
Figure 4C:
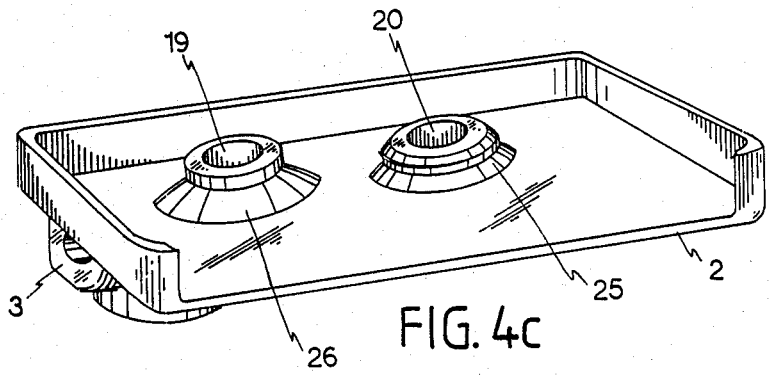

In FIG. 4*c*, base 2 is seen to include a base. plate, walls, integrally attached channeled housing 3, and fluid guides 25 and 26 in the base plate forming the upper sections of the valve chambers, fluid guides 25 and 26 having liquid flow outlets 20 and 19 respectively at the tops thereof.

The center plate 6, depicted in FIG. 4*b* is shown with walls, opening 19 for liquid from valve 11' and a deflection cap 18 for liquids from valve 11. Additionally shown, and preferred in the present invention, are internally positioned wall extensions 23 and 23', as supporting members.

Figure 4D:
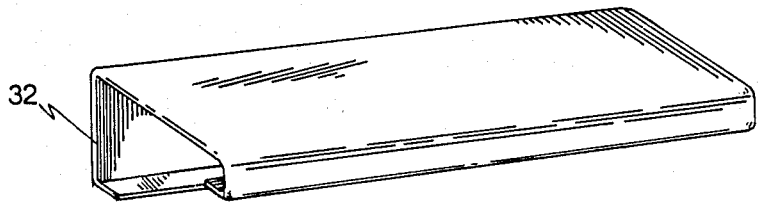

The cover plate 8 shown in FIG. 4*a* is shown as having walls 10, previously discussed. The outer surface of plate 8 may be suitably decorative, or, alternately, be overlaid with removable and replaceable snap-on overlay trim such as shown in FIG. 4*d*. Trim members, when used, may be fashioned from a variety of materials, including polished stainless steel, copper and the like.

Figure 5A:
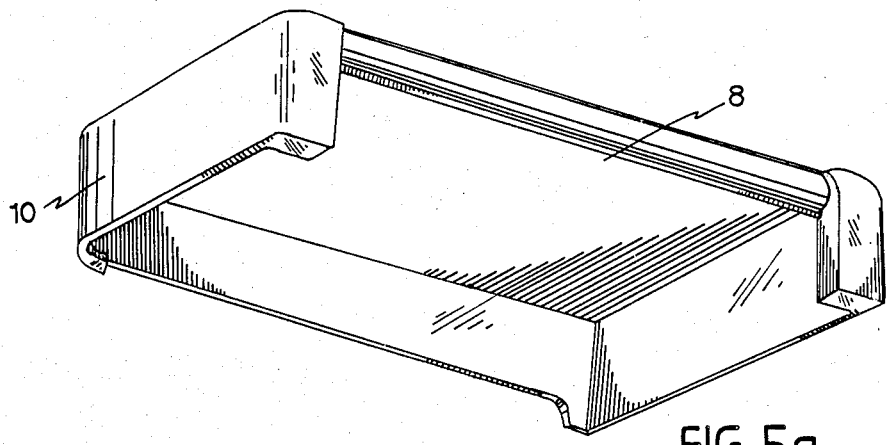
FIGS. 5*a*–5*c* are an exploded bottom perspective view of the body components of the unit.
Figure 5B:
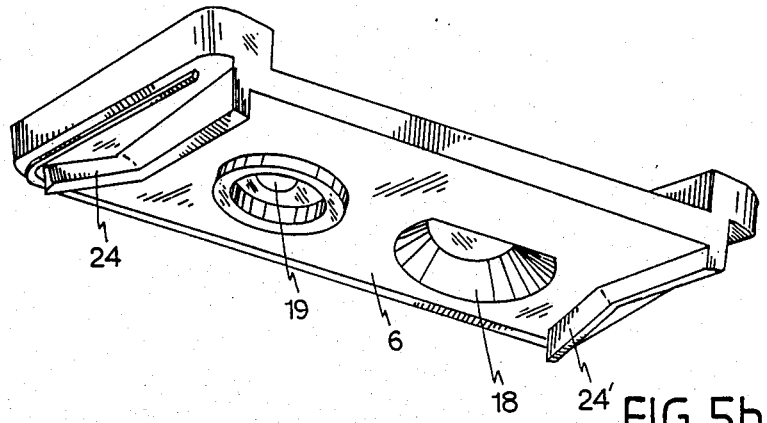
Figure 5C:
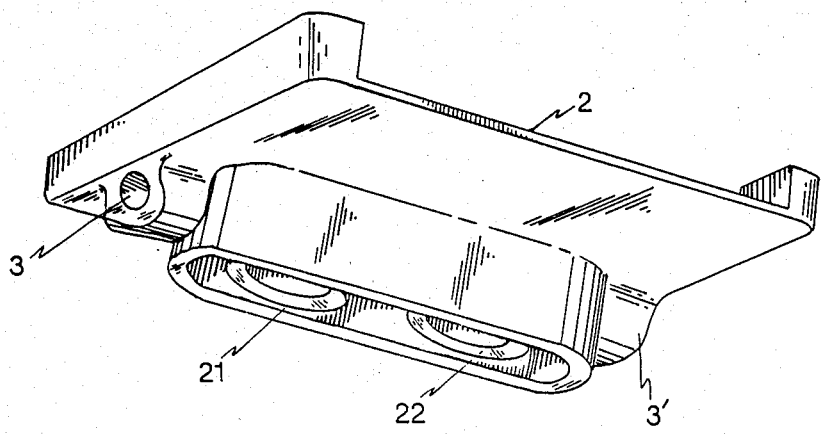

An exploded perspective view of the unit from the underside of the elements is depicted in FIGS. 5*a–c*.

FIG. 5*a* is a simple perspective depiction of the cover plate 8 with unit-encompassing walls 10.

FIG. 5*b* displays perspectively the bottom of center plate 6 with offset 18 which extends over the top of valve 11' as seen in FIG. 1. In a preferred embodiment, and as shown in FIG. 5*b*, two support guide ribs 24 and 24' are provided on the bottom of plate 6, each rib being of sufficient height to abut against the top of base 2 when plate 6 is assembled with base 2.

The perspective view of FIG. 5*c* shows the underside of base 2, with threaded insert housings at 21 and 22 and channeled housings 3 and 3' for receiving and retaining the arms of the fluid flow control levers.

The operation of the cascade spout of the present invention may be illustrated as follows With the unit mounted in place on a whirlpool bath o spa, a pipe is operatively connected to insert 4 of the recirculation line and insert 5 is operatively connected to hot and cold water lines to permit water temperature adjustment. Valve control handle 14' is moved to the "on" position, with water at the desired temperature moving through insert 5, past the corresponding valve and emitting from chamber 9 in a cascade or sheet, the velocity of which is determined by the degree of water flow provided by the hot and cold water flow. If the plumbing piping connected to insert 5 is also connected to an overhead shower, valve 14' may be closed to divert the water to the shower.

Once the bath is filled, and the whirlpool pump is started, valve 14 can be positioned at "on" with recirculation effected to cause recirculated water to pass through insert 4 to chamber 7 and to cascade from chamber 7 in a continuous flow.

The materials employed in fabricating the double cascade unit may be any of the several materials known in the art for producing similar units.

From the foregoing description of the invention in its preferred form, illustrated and described in considerable detail, it will be further apparent that the same is subject to alteration and modification without departing from the underlying principles involved, and is not to be so limited, except as may be necessitated by the appended claims.

We claim:

1. A wide mouth double cascade delivery unit connectable to at least two liquid delivery pipes for emitting a curtain of liquid therefrom comprising:

superimposed elongated upper and lower liquid receiving and dispensing chambers, each of said chambers being in atmospheric communication via a long narrow slot in a side of said chamber, the length of each of said slots being substantially equal to the length of the cross-section of each of said chambers transverse to the flow of liquid from said chambers;

a first liquid delivery insert;

a second liquid delivery insert and each of said chambers having a bottom, wherein the bottom of said lower chamber has first and second laterally spaced apart apertures therein, and wherein the bottom of said upper chamber has a third aperture therein, said second and third apertures being co-axial, whereby said first insert is inserted through said first aperture, and conveys liquid into said lower chamber therethrough, and whereby said second insert is inserted through said second and third apertures, and conveys liquid into said upper chamber therethrough, and independent valve means in said first and second inserts for controlling liquid flow through said first and said second delivery inserts.

2. The delivery unit as claimed in claim 1, wherein said valve means comprises a first valve located in said first insert and a second valve located in said second insert, said first and second valves each being ball valves.

3. The delivery unit as claimed in claim 2, wherein said valve means further comprises a shaft and a lever connected to each of said first and second valves, said levers being operable so as to control the flow of water through said valves.

4. The delivery unit as claimed in claim 1, comprising a base plate having three upwardly extending walls and a center plate having three upwardly extending walls, said center plate being superimposed on said base plate so as to define said lower chamber therebetween.

5. The delivery unit as claimed in claim 4, further comprising a cover superimposed on said center plate so as to define said upper chamber therebetween.

6. The delivery unit as claimed in claim 5, wherein said center plate has an opening formed therein, and said base plate has a fluid guide with an opening formed therein, said fluid guide cooperating with one of said delivery inserts so as to direct fluid through said openings into said upper chamber.

7. The delivery unit as claimed in claim 5, wherein said center plate has a deflection cap pressed upwardly from the center plate, and said base plate has a fluid guide with an opening formed therein, said fluid guide cooperating with one of said delivery inserts so as to direct fluid through said opening against the deflection plate and into said lower chamber.

8. The delivery unit as claimed in claim 5, wherein said center plate and said cover are angled with respect to said base plate so as to direct fluid downwardly.

9. The delivery unit as claimed in claim 5, further comprising a first flow ramp connected to said cover and located in said upper chamber and a second flow ramp connected to said center plate and located in said lower chamber, said flow ramps directing fluid exiting from the chambers downwardly.

10. The delivery unit as claimed in claim 11, wherein said flow ramps have a plurality of locating pins projecting therefrom which cooperate frictionally with openings in said cover and said center plate so as to connect said first and second flow ramps to said cover and said center plane, respectively.

11. A wide mouth double cascade delivery unit for a whirlpool bath, said unit comprising:

an adjustable source of hot and cold fill water;

a recirculation system for recirculating water in the whirlpool bath;

superimposed elongated upper and lower liquid receiving and dispensing chambers, each of said chambers being in atmospheric communication via a long, narrow slot in a side of said chamber, the length of each of said slots being substantially equal to the length of the cross-section of each of said chambers transverse to the flow of liquid from said chambers;

a first liquid delivery insert conveying water to one of said chambers, said first insert being operatively connectable to the adjustable source of hot and cold fill water;

a second liquid delivery insert operatively connectable to the other chamber and to the recirculation system of said whirlpool bath for delivery of at least a portion of recirculated water to the other chamber; and independent valve means in said first and said second inserts for controlling liquid flow through said first and said second delivery inserts and from said upper and said lower chambers.

12. The delivery unit as claimed in claim 3, wherein said valve means comprises a first valve located in said first insert and a second valve located in said second insert, said first and second valve each being ball valves.

13. The delivery unit as claimed in claim 12, wherein said valve means further comprises a shaft and a lever connected to each of said first and second valves, said levers being operable so as to control the flow of water through said valves.

14. The delivery unit as claimed in claim 11, comprising a base plate having three upwardly extending walls and a center plate having three upwardly extending walls, said center plate being superposed on said base plate so as to define said lower chamber therebetween.

15. The delivery unit as claimed in claim 14, further comprising a cover superimposed on said center plate so as to define said upper chamber therebetween.

16. The delivery unit as claimed in claim 15, wherein said center plate has an opening formed therein, and said base plate has a fluid guide with an opening formed therein, said fluid guide cooperating with one of said delivery inserts so as to direct fluid through said openings into said upper chamber.

17. The delivery unit as claimed in claim 15, wherein said center plate has a deflection cap pressed upwardly from the center plate, and said base plate has a fluid guide with an opening formed therein, said fluid guide cooperating with one of said delivery inserts so as to direct fluid through said opening against the deflection plate and into said lower chamber.

18. The delivery unit as claimed in claim 15, wherein said center plate and said cover are angled with respect to said base plate so as to direct fluid downwardly.

19. The delivery unit as claimed in claim 15, further comprising a first flow ramp connected to said cover and located in said upper chamber and a second flow ramp connected to said center plate and located in said lower chamber, said flow ramps directing fluid exiting form the chambers downwardly.

20. The delivery unit as claimed in claim 19, wherein said flow ramps have a plurality of locating pins projecting therefrom which cooperate frictionally with openings in said cover and said center plate so as to connect said first and second flow ramps to said cover and said center plate, respectively.

21. A wide mouth double cascade delivery unit connectable to at least two liquid delivery pipes for emitting a curtain of liquid therefrom comprising:

a four-sided base plate having three side walls which extend upwardly form three sides of said base plate;

a four-sided center plate having three side walls which extend upwardly from three sides of said center plate, said center plate being superimposed on said base plate so as to form a lower liquid receiving and dispensing chamber between the center plate and the base plate, said lower chamber being in atmospheric communication via first long narrow slot extending completely along a fourth side of the base plate between the center plate and the base plate;

a cover superimposed on said center plate so as to form an upper liquid receiving and dispensing chamber between the cover and the center plate, said upper chamber being in atmospheric communication via a second long narrow slot located above the first slot and extending completely along a fourth side of the center plate between the cover and the center plate;

a first liquid delivery insert;

a second liquid delivery insert and wherein said base plate has first and second laterally spaced apart apertures therein, and wherein said center plate has a third aperture therein, said second and third apertures being co-axial, whereby said first insert is inserted through said first aperture, and conveys liquid into said lower chamber therethrough, and whereby said second insert is inserted through said second and third apertures, and conveys liquid into said upper chamber therethrough, and independent valve means in said first and second inserts for controlling liquid flow through said first and said second delivery inserts.

22. The delivery unit as claimed in claim 21, wherein said valve means comprises a first valve located in said first insert and a second valve located in said second insert, said first and second valves each being ball valves.

23. The delivery unit as claimed in claim 22, wherein said valve means further comprises a shaft and a lever connected to each of said first and second valves, said levers being operable so as to control the flow of water through said valves.

24. The delivery unit as claimed in claim 21, wherein said center plate has an opening formed therein, and said base plate has an upwardly extending fluid guide with an opening formed therein, said fluid guide cooperating with one of said delivery inserts so as to direct fluid through said openings into said upper chamber.

25. The delivery unit as claimed in claim 21, wherein said center plate has a deflection cap pressed upwardly from the center plate so that an upper surface of the deflection cap contacts the cover, and said base plate has an upwardly extending fluid guide with an opening formed therein, said fluid guide cooperating with one of said delivery inserts so as to direct fluid through said opening against the deflection plate and into said lower chamber.

26. The delivery unit as claimed in claim 21, wherein said center plate and said cover are angled with respect to said base plate so as to direct fluid downwardly.

27. The delivery unit as claimed in claim 21, further comprising a first flow ramp connected to said cover and located in said upper chamber and a second flow ramp connected to said center plate and located in said lower chamber, said flow ramps directing fluid exiting from the chambers downwardly.

28. The delivery unit as claimed in claim 28, wherein said flow ramps have a plurality of locating pins projecting therefrom which cooperate frictionally with openings in said cover and said center plate so as to connect said first and second flow ramps to said cover and said center plate, respectively.

* * * * *